US005265858A

United States Patent [19]

Hobbs et al.

[11] Patent Number: 5,265,858

[45] Date of Patent: Nov. 30, 1993

[54] APPARATUS FOR CONVERTING A SHEET MATERIAL FEEDER FROM ON EDGE TO BOTTOM FEED

[75] Inventors: John N. Hobbs, Troy; Dale K. Wells, Englewood, both of Ohio

[73] Assignee: AM International, Inc., Chicago, Ill.

[21] Appl. No.: 970,125

[22] Filed: Nov. 2, 1992

[51] Int. Cl.[5] ..... B65H 5/08

[52] U.S. Cl. ..... 271/11; 271/10; 271/100; 271/277; 271/150; 271/162; 271/165

[58] Field of Search ..... 271/31.1, 99, 100, 107, 271/149, 150, 162, 165, 277, 10, 11

[56] References Cited

U.S. PATENT DOCUMENTS

| | | | |
|---|---|---|---|
| 1,043,401 | 11/1912 | Cox . | |
| 3,446,498 | 5/1969 | Reist | 271/100 |
| 3,717,337 | 2/1973 | McCain et al. | 271/100 X |
| 4,180,255 | 12/1979 | Himmel . | |
| 4,358,100 | 11/1982 | Müller | 271/277 X |
| 4,976,420 | 12/1990 | Flensburg et al. . | |
| 5,026,038 | 6/1991 | Weller et al. | 271/165 X |
| 5,080,341 | 1/1992 | Luthy . | |
| 5,137,264 | 8/1992 | Cloutier et al. . | |
| 5,164,906 | 11/1992 | Mahmoodi et al. | 271/9 X |

*Primary Examiner*—Robert P. Olszewski
*Assistant Examiner*—Boris Milef
*Attorney, Agent, or Firm*—Tarolli, Sundheim & Covell

[57] ABSTRACT

An existing sheet material feeder has a feed tray which holds sheet material in an on-edge orientation in which side surfaces of the sheet material are generally vertical. An apparatus is provided to convert the sheet material feeder to one having a feed tray which holds sheet material in a lying-down orientation in which side surfaces of the sheet material are generally horizontal. The apparatus for converting the on-edge sheet material feeder to the lying-down sheet material feeders includes a frame having a pair of parallel side sections. A single sheet material feed drum is disposed between and is connected with the side sections. The side sections are connected with side sections of the existing collator conveyor sheet material feeder.

6 Claims, 5 Drawing Sheets

APPARATUS FOR CONVERTING A SHEET MATERIAL FEEDER FROM ON EDGE TO BOTTOM FEED

BACKGROUND OF THE INVENTION

The present invention relates to an apparatus for converting a collator conveyor sheet material feeder which receives signatures in an on-edge orientation to a collator conveyor sheet material feeder which receives signatures in a lying-down orientation.

A known collator conveyor sheet material feeder has a hopper which holds sheet material in an on-edge orientation in which side surfaces of the sheet material are generally vertical. The sheet material is engaged by a rotatable feed drum. A transfer drum and an opener drum receive sheet material from the feed drum and open the sheet material. The opened sheet material is deposited on a saddle type conveyor. A known apparatus having this construction is disclosed in U.S. Pat. No. 4,180,255 issued Dec. 25, 1979 and entitled Wiper System Inserter.

SUMMARY OF THE INVENTION

The present invention provides an improved apparatus and method for converting a collator conveyor sheet material feeder. The apparatus converts the feeder from one which receives sheet material in an on-edge orientation to a feeder which receives sheet material in a lying-down orientation. It is contemplated that the apparatus may be utilized as a unit which is retrofitted to convert existing sheet material feeders.

The apparatus for converting a collator sheet material feeder includes a pair of parallel side sections. Fasteners are provided to secure the side sections of the apparatus to side sections of the collator conveyor sheet material feeder. The converter apparatus includes a single sheet material feed drum which is disposed between and connected with the side sections. The single sheet material feed drum is the only sheet material feed drum disposed between the side sections of the converter apparatus.

BRIEF DESCRIPTION OF THE DRAWINGS

The foregoing and other features of the invention will become more apparent upon a consideration of the following description taken in connection with the accompanying drawings wherein.

DESCRIPTION OF PREFERRED EMBODIMENT OF THE INVENTION

Figure 1:
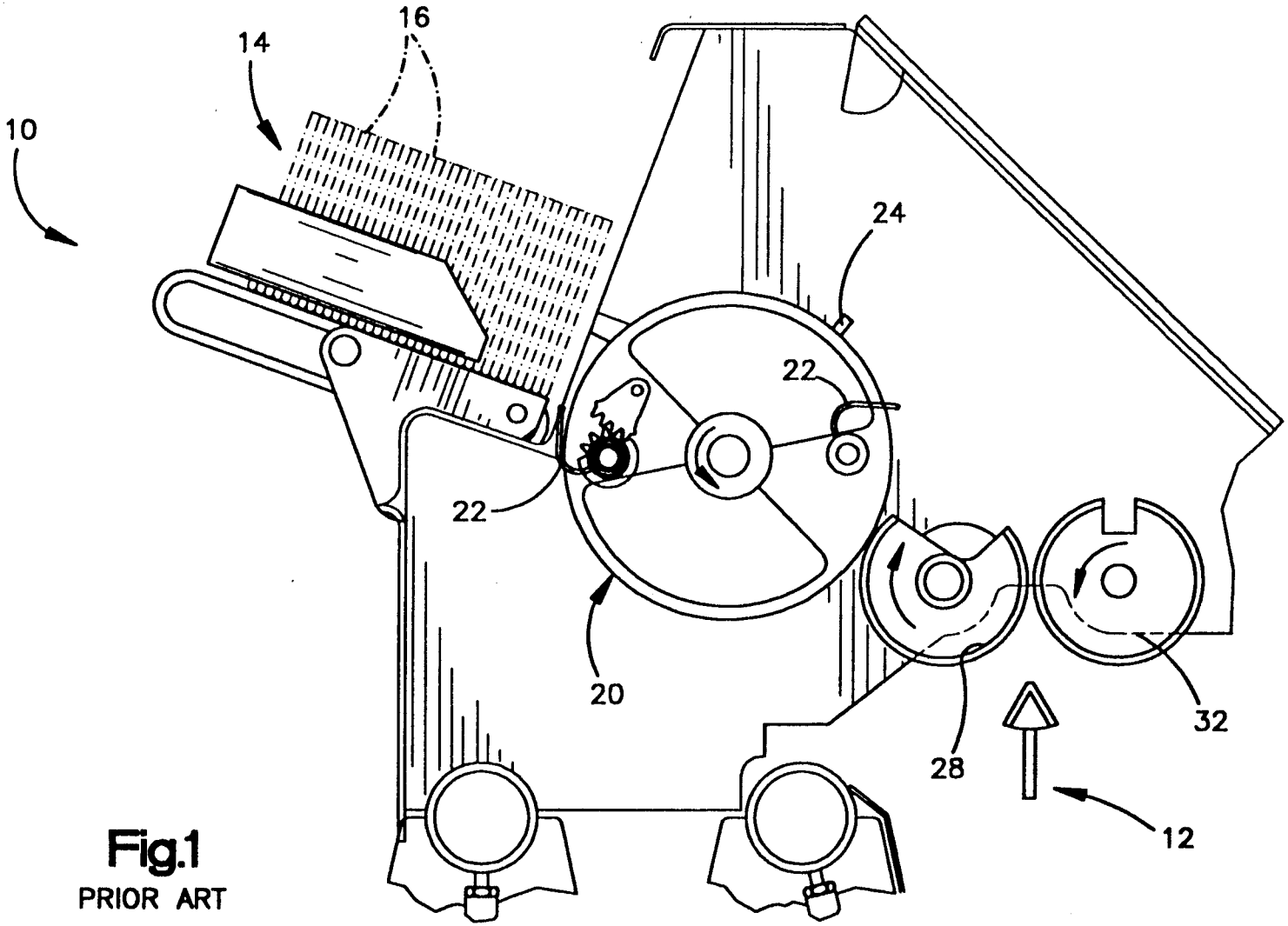
Fig.1 PRIOR ART
FIG. 1 is a side elevational view, partly in section, of a known collator conveyor sheet material feeder which feeds sheet material from an on-edge orientation.

A known collator conveyor sheet material feeder 10 (FIG. 1) is utilized to feed sheet material onto a saddle conveyor 12. The feeder 10 includes a hopper 14 which is loaded with sheet material articles 16. The articles 16 are in an on-edge orientation in which side surfaces of the sheet material articles are generally vertical.

A rotatable feed drum 20 has grippers 22 which engage folded lower edge portions of the sheet material articles 16. The feed drum 20 rotates in a counterclockwise direction (as viewed in FIG. 1) and sequentially moves a folded leading edge portion of a sheet material article into engagement with a stop 24. The trailing edge portion of the sheet material article is then engaged by a transfer drum 28. The transfer drum 28 rotates in a clockwise direction and has grippers which engage the trailing edge portion of the sheet material article. An opener drum 32 cooperates with the transfer drum 28 to open the sheet material article in a known manner and deposit the sheet material article onto a saddle conveyor 12.

The construction of the sheet material feeder 10 is the same as is disclosed in the aforementioned U.S. Pat. No. 4,180,255. However, it should be understood that the feeder 10 could have other known constructions. It should also be understood that although the on-edge sheet material articles are moved to the feed drum 20 from the hopper 14, the sheet material articles could be fed to the feed drum from a conveyor apparatus similar to that disclosed in U.S. Pat. No. 4,973,038.

Although the collator conveyor sheet material feeder 10 is generally satisfactory in its mode of operation, there are circumstances in which it may be desired to have the sheet material articles 16 fed from a lying-down orientation in which side surfaces of the sheet material articles are generally horizontal. A converter assembly 40 (FIG. 2) constructed in accordance with the present invention, is used to convert the collator conveyor sheet material feeder 10 to a feeder which feeds sheet material 16 from a lying-down orientation in which side surfaces of the sheet material are generally horizontal.

The converter assembly 40 includes a feed tray 44. The feed tray 44 includes a support plate 46 having a flat upwardly facing side surface 48. Although the upwardly spacing side surface 48 of the support plate 46 has a slight downward slope, the side surface is considered as being generally horizontal. Sheet material articles are received on the plate 46 with side surfaces of the sheet material horizontal and folded edge portions of the sheet material toward the right, as viewed in FIG. 2. The sheet material may be fed directly into the feed tray 44 by a loader conveyor assembly similar to that disclosed in U.S. Pat. No. 3,904,191 or may be manually loaded into the feed tray.

Figure 4:
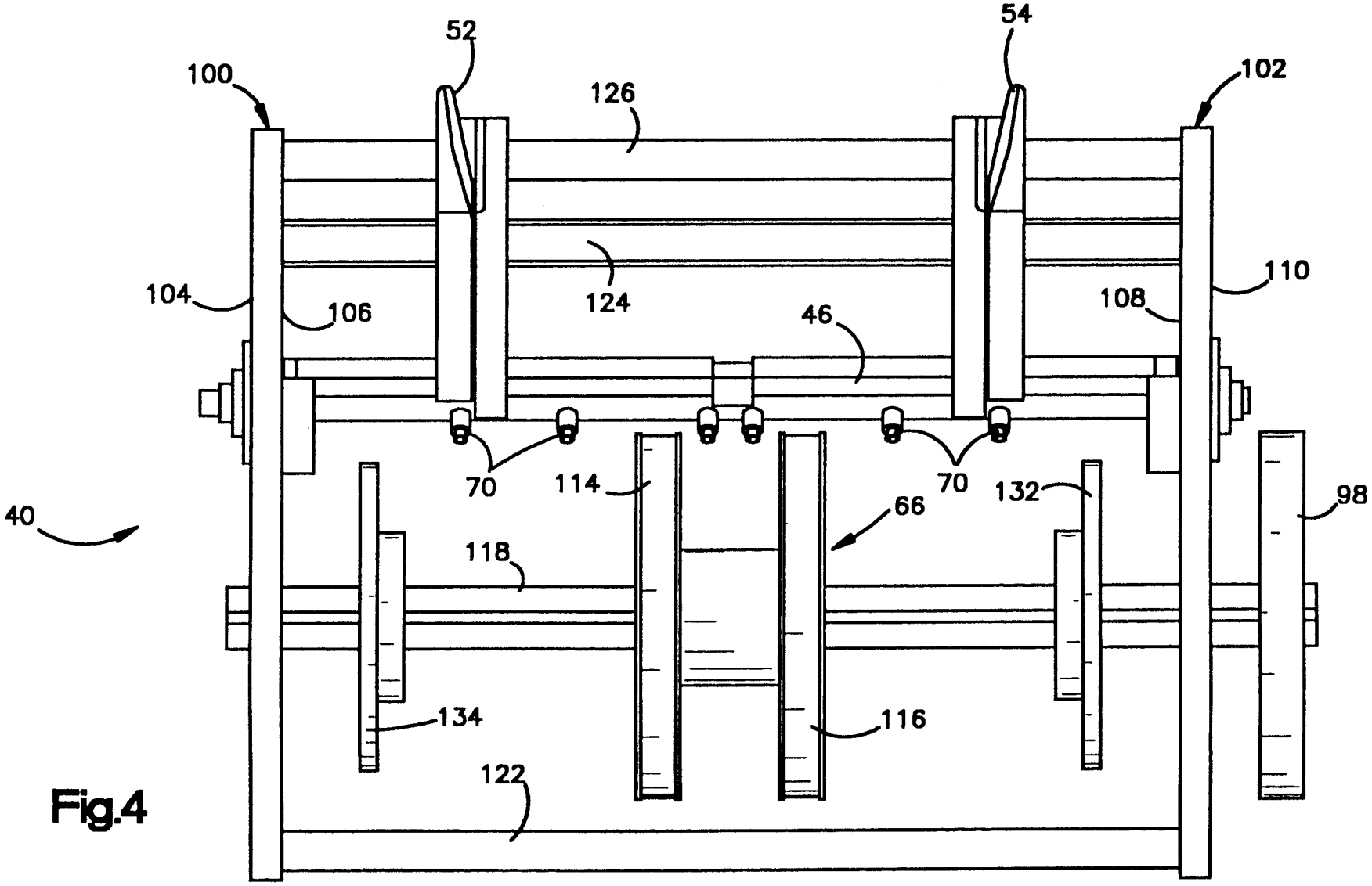
FIG. 4 is an end view, taken generally along the line 4—4 of FIG. 2, further illustrating the construction of the converter apparatus.

The feed tray 44 has a pair of side guides 52 and 54 (FIG. 4) which extend upwardly from the plate 46. A rear guide 58 has a registration surface 60. A guide surface 64 slopes forwardly (toward the right as viewed in FIG. 2) and downwardly to the generally vertical registration surface 60. The sloping guide surface 64 cams the trailing edge portions of the sheet material forwardly so that the sheet material is registered by the vertical registration surface 60 on the rear guide 58.

If a hopper loader, such as that disclosed in U.S. Pat. No. 3,904,191, is utilized to load the feed tray 44, the sheet material articles will be conducted into the feed tray at a location just above the upper edge portion of the rear guide 58. The location of the rear guide 58 relative to the support plate 46 can be adjusted to accommodate sheet material articles of different sizes. In addition, the side guides 52 and 54 can also be adjusted relative to the support plate 46 to accommodate different size sheet material articles.

When the known collator conveyor sheet material feeder 10 of FIG. 1 is to be converted from a feeder which feeds sheet material from an on-edge orientation to a feeder which feeds sheet material from a lying-down orientation, the hopper 14 (FIG. 1) is removed from the feeder 10. The converter assembly 40 is connected with the feeder 10. A single feed drum 66 in the converter assembly 40 is then operable to feed sheet material from a lying-down orientation in the feed tray 44 to the feed drum 20 in the collator conveyor sheet material feeder 10. If it is subsequently desired to utilize the collator conveyor sheet material feeder 10 to feed sheet material in an on-edge orientation, the converter assembly 40 is merely disconnected from the feeder and the hopper 14 reconnected with the feeder.

In addition to the single feed drum 66, the converter assembly 40 includes a plurality of vacuum suckers 70. When the vacuum suckers 70 are in the initial position shown in FIG. 2, they engage and apply suction to a downwardly facing and generally horizontal side surface of a lowermost sheet material article in the feed tray 44. The suckers 70 are then pivoted downwardly, in a clockwise direction as viewed in FIG. 2, to pull the folded edge portion of the lowermost sheet material article downwardly to a position in which it can be gripped by the feed drum 66.

Figure 2:
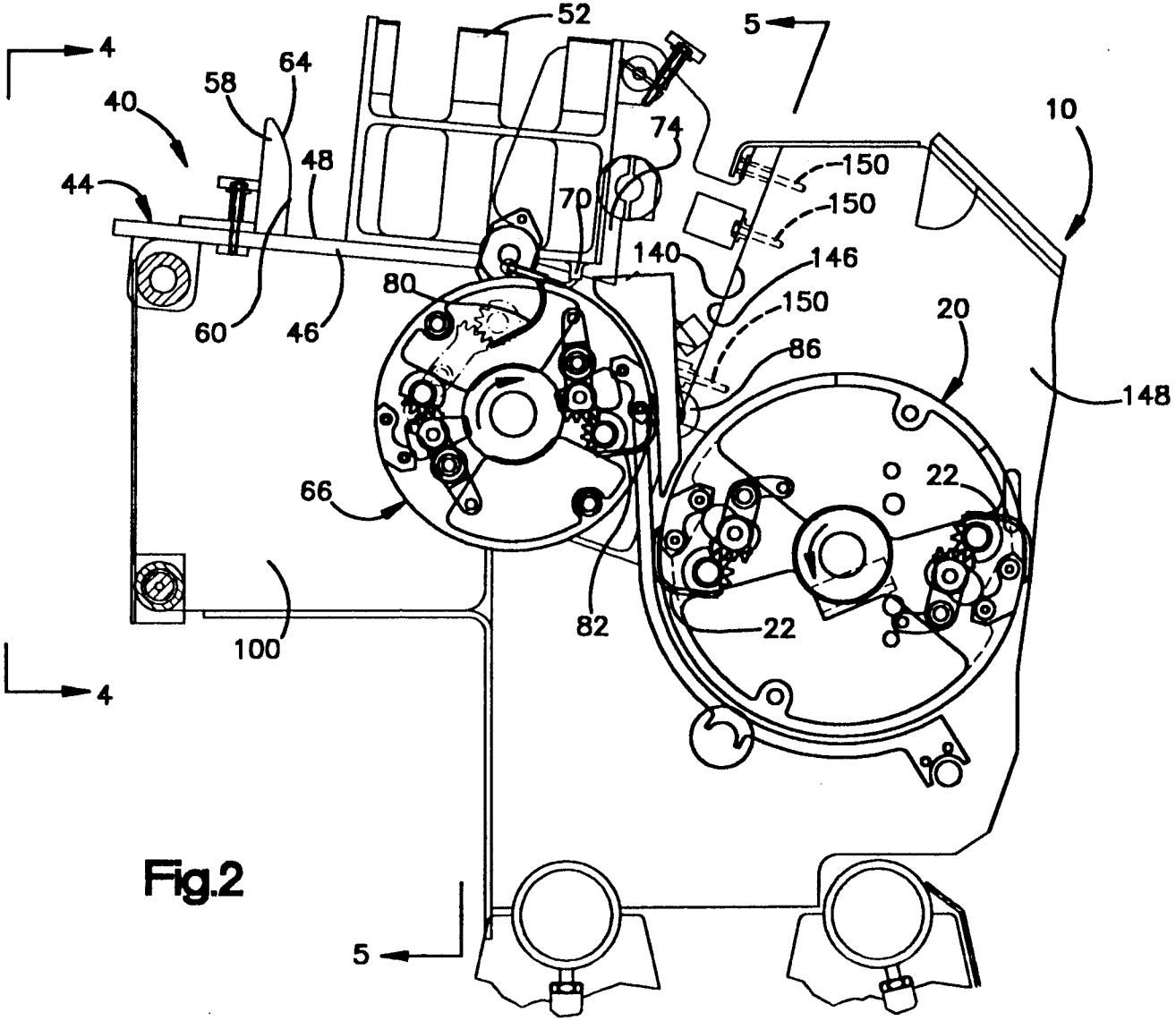
FIG. 2 is a side elevational view, generally similar to FIG. 1, illustrating the use of a converter apparatus, constructed in accordance with the present invention, to convert the feeder of FIG. 1 to feed sheet material from a lying-down orientation.

Immediately after the folded leading edge portion of the lower sheet material article has been pulled downwardly by the suckers 70, a lift hook 74 is swung in a clockwise direction from a retracted position offset to the right of the position shown in FIG. 2 to the engaged position shown in FIG. 2. When the lift hook 74 is in the engaged position, it extends between the downwardly deflected leading edge portion of the sheet material article engaged by the suckers 70 and the next succeeding sheet material article in the stack of sheet material articles. This enables the lift hook 74 to partially support the stack of lying-down sheet material articles disposed in the feed tray 44 as the lowermost article is withdrawn from the feed tray.

A pair of grippers 80 and 82 are provided on the drum 66. One of the grippers 80 or 82, for example, the gripper 80, is then closed to grip the downwardly deflected edge portion of the sheet material article. Continued clockwise rotation of the feed drum 66 pulls the leading edge portion of the sheet material article downwardly where it can be engaged by one of the grippers 22 on the feed drum 20. A pinch roller 86 is provided in the converter assembly 40 to press the sheet material article against the feed drum 66 as the sheet material article is being moved downwardly toward the feed drum 20.

Figure 3:
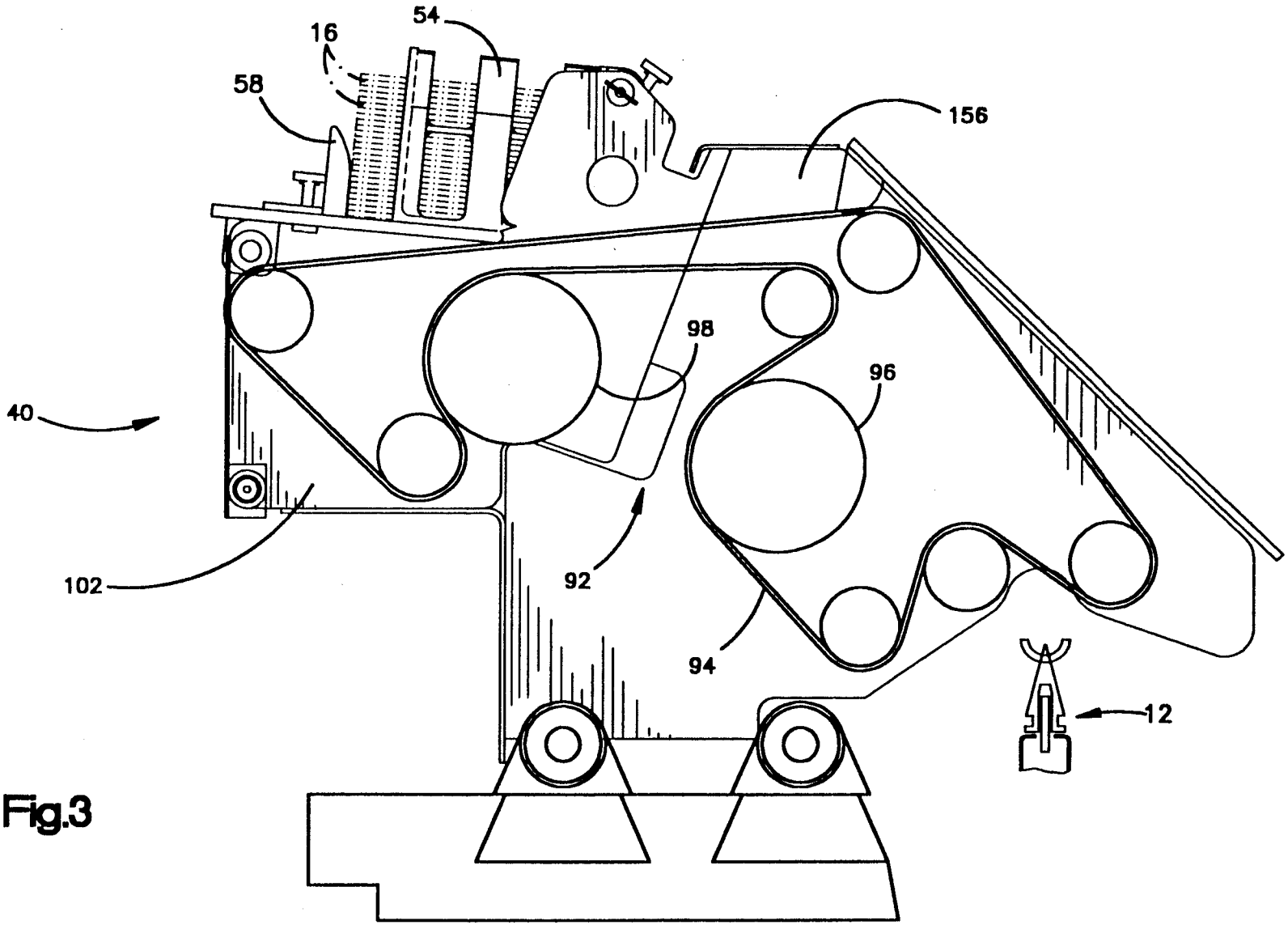
FIG. 3 is a side elevational view of the apparatus of FIG. 2 and illustrating a drive system.

A drive assembly 92 (FIG. 3) is provided to drive the components of the collator conveyor sheet material feeder 10 and the converter assembly 40. The drive assembly 92 includes a single toothed drive belt 94 which extends around a toothed drive wheel or gear 96. The gear 96 is connected with the feed drum 20 in the collator conveyor sheet material feeder 10. The belt 94 also extends around a circular toothed wheel or gear 98 in the converter assembly 40. The belt 94 engages other drive wheels to drive other components of the feeder 10 and the converter assembly 40.

The converter assembly 40 includes a pair of side sections 102 (FIG. 4) having parallel major side surfaces 104, 106, 108 and 110. The feed drum 66 has a pair of cylindrical sections 114 and 116 (FIG. 4) which are fixedly secured to a shaft 118 which is rotatably supported by the side sections 100 and 102. The drive wheel 98 is connected with one end portion of the shaft 118 Spacer bars 122, 124 and 126 extend between the side sections 100 and 102 and maintain them in a spaced apart parallel relationship.

A sucker drive cam 132 rotates with the shaft 118 to raise and lower the suckers 70 in timed relationship with rotation of the feed drum 66. In addition, a lift hook cam 134 rotates with the shaft 118 to move the lift hook 74 (FIG. 2) between the retracted position in which it is spaced from the feed tray 44 and the engaged position in which it extends beneath a stack of sheet material articles in the feed tray 44.

Figure 5:
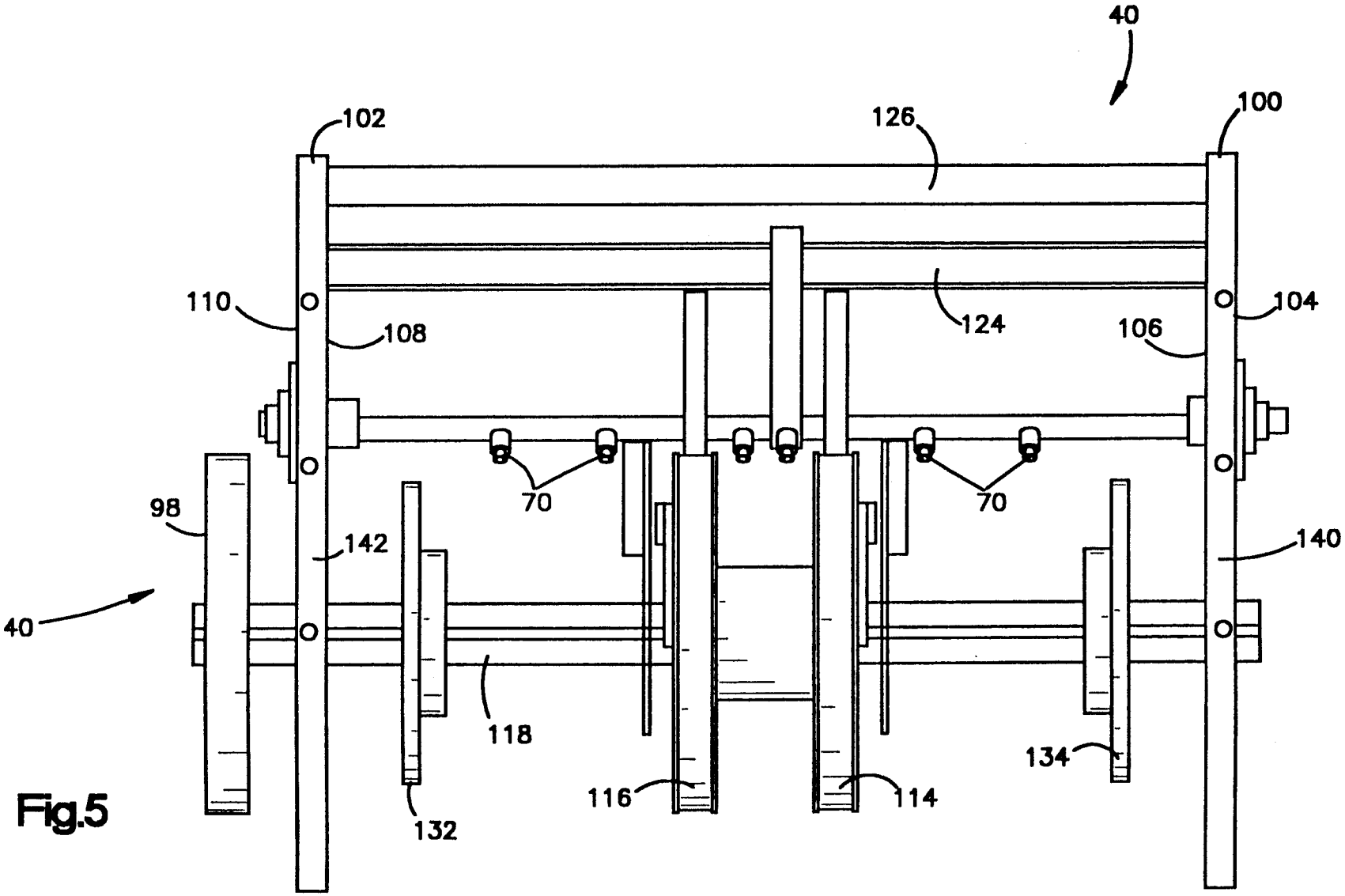
FIG. 5 is an end view, taken generally along line 5—5 of FIG. 2, further illustrating the construction of the converter apparatus.

The support sections 100 and 102 have flat minor side surfaces 140 and 142 (FIG. 5) which engage flat minor side surfaces of side sections on the collator conveyor sheet material feeder 10. Thus, the minor side surface 140 of the side section 100 of the converter assembly 40 is disposed in flat abutting engagement with a minor side surface 146 (FIG. 2) on the side section 148 of the collator conveyor sheet material feeder 10. Fasteners 150 (FIG. 2) interconnect the side section 100 of the converter assembly 40 and side section 148 of the collator conveyor sheet material feeder 10.

In the illustrated embodiment of the invention, the fasteners 150 are bolts which extend through holes drilled in the side section 100 of the converter assembly 40 into threaded engagement with tapped holes formed in the side section 148 of the feeder 10. It is contemplated that other types of connections could be utilized if desired. For example, an overlapping plate type of connection could be used.

Although only the abutting engagement between the minor side surfaces 140 and 146 of the converter assembly side section 100 and feeder side section 148 have been shown in FIG. 2, it should be understood that the minor side surface 142 (FIG. 5) on the converter assembly 40 side section 102 is connected in flat abutting engagement with a corresponding minor side surface on a side section 156 (FIG. 3) of the feeder 10. In addition, fasteners, corresponding to the bolts 150, are utilized to interconnect the side section 102 of the converter assembly 40 and the side section 156 of the feeder 10.

In view of the foregoing description, it is apparent that the present invention provides an apparatus 40 and method for converting a collator conveyor sheet material feeder 10. The converter assembly 40 converts the feeder 10 from one which receives sheet material in an on-edge orientation (FIG. 1) to a feeder which receives sheet material in a lying-down orientation (FIG. 2). It is contemplated that the converter assembly 40 will be utilized as a unit which is retrofitted to convert existing collator sheet material feeders.

The converter assembly 40 includes a pair of parallel side sections 100 and 102. Fasteners 150 are provided to secure the side sections 100 and 102 of the converter assembly 40 to side sections 148 and 156 of the sheet material feeder. The converter assembly 40 includes a single sheet material feed drum 66 which is disposed between and connected with the side sections 100 and 102. The single sheet material drum 66 is the only sheet material feed drum disposed between the side sections 100 and 102 of the converter assembly 40.

Having described one specific preferred embodiment of the invention, the following is claimed:

1. An apparatus for converting a collator conveyor sheet material feeder which feeds sheet material from an on-edge orientation in which side surfaces of the sheet material are generally vertical to a collator conveyor sheet material feeder which feeds sheet material from a lying-down orientation in which side surfaces of the sheet material are generally horizontal, said apparatus comprising first and second parallel and spaced apart side sections, fastener means for securing said first and second side sections to side sections of the collator conveyor sheet material feeder, a single sheet material feed drum disposed between and connected with said first and second side sections and rotatable about an axis extending perpendicular to said major side surfaces of said first and second side sections, said single sheet material feed drum being the only sheet material feed drum disposed between said first and second side sections, and spacer means extending between said first and second side sections for interconnecting said first and second side sections and maintaining said first and second side sections in a spaced apart and parallel relationship.

2. An apparatus as set forth in claim 1 further including sucker means connected with said first side section for sequentially engaging generally horizontal side surfaces of sheet material and pulling the engaged sheet material downwardly toward said single sheet material feed drum.

3. An apparatus as set forth in claim 1 further including pinch roller means connected with said first side section for pressing sheet against said single sheet material feed drum.

4. An apparatus as set forth in claim 1 wherein said single sheet material feed drum includes a plurality of gripper assemblies for sequentially engaging edge portions of sheet material while major side surface areas of the sheet material are generally horizontal and for moving the sheet material toward a sheet material feed drum in a collator conveyor sheet material feeder.

5. An apparatus as set forth in claim 1 further including a circular drive member connected with said sheet material feed drum and disposed on a side of said first side section opposite from said sheet material feed drum and belt means interconnecting said circular drive member and the collator conveyor sheet material feeder for transmitting drive force to said circular drive member.

6. An apparatus as set forth in claim 1 wherein said first and second side sections each have parallel major side surfaces and at least one minor side surface which extends between said major side surfaces, said fastener means secures said first side section to a side section of the collator conveyor sheet material feeder with said one minor side surface on said first side section in abutting engagement with a minor side surface of one of the side sections of the collator conveyor sheet material feeder, said fastener means secures said second side section to a side section of the collator conveyor sheet material feeder with said one minor side surface on said second side section in abutting engagement with a minor side surface of one of the side sections of the collator conveyor sheet material feeder.

* * * * *